US006322863B1

(12) United States Patent
Kubicky

(10) Patent No.: US 6,322,863 B1
(45) Date of Patent: Nov. 27, 2001

(54) UTILITY POLE WITH PIPE COLUMN AND REINFORCING RODS COMPRISED OF SCRAP RUBBER AND PLASTIC

(75) Inventor: Paul J. Kubicky, 1090 Media Line Rd., Newtown Square, PA (US) 19073

(73) Assignee: Paul J. Kubicky, Newtown Square, PA (US)

( * ) Notice: Subject to any disclaimer, the term of this patent is extended or adjusted under 35 U.S.C. 154(b) by 0 days.

(21) Appl. No.: 09/339,478

(22) Filed: Jun. 24, 1999

Related U.S. Application Data

(63) Continuation-in-part of application No. 08/904,720, filed on Aug. 1, 1997, now abandoned.

(51) Int. Cl.[7] ..... E04C 3/30; E04C 3/36

(52) U.S. Cl. ..... 428/34.5; 428/35.7; 428/36.8; 428/36.9; 428/903.3; 52/736.1; 52/736.2; 52/736.3; 52/736.4; 52/737.1; 52/DIG. 9

(58) Field of Search ..... 428/35.7, 36.8, 428/36.9, 36.91, 903.3, 34.5; 52/DIG. 9, 737.1, 736.1, 736.2, 736.3, 736.4

(56) References Cited

U.S. PATENT DOCUMENTS

| | | | | |
|---|---|---|---|---|
| 5,051,285 | | 9/1991 | Borzakian . | |
| 5,094,905 | * | 3/1992 | Murray | 428/218 |
| 5,180,531 | | 1/1993 | Borzakian . | |
| 5,246,754 | | 9/1993 | Miller . | |
| 5,412,921 | | 5/1995 | Tripp . | |
| 5,471,809 | | 12/1995 | Frankel . | |
| 5,472,750 | | 12/1995 | Miller . | |
| 5,507,473 | | 4/1996 | Hammer . | |
| 5,513,477 | | 5/1996 | Farber . | |
| 5,650,224 | * | 7/1997 | March et al. | 428/297 |
| 5,658,519 | * | 8/1997 | March et al. | 264/2.77 |
| 5,675,956 | * | 10/1997 | Nevin | 52/726.1 |

* cited by examiner

*Primary Examiner*—Rena L. Dye

(57) ABSTRACT

A multi purpose recycled utility pole with internal reinforcing rods 18 and pipe column 20. The utility pole is comprised of scrap rubber emulsion 14, which is a combination of scrap tires in ground form, commonly known as ground tire rubber, ground plastic, a UV protectant and fire retardant with a urethane binder. Scrap rubber emulsion 14 is dispensed into a steel plate casing 12 and compressed until completely filled. After compaction, the scrap rubber emulsion 12 will be hardened for several hours and the steel plate casing 12 will unbolt to remove the finished utility pole.

4 Claims, 7 Drawing Sheets

Figure 1:
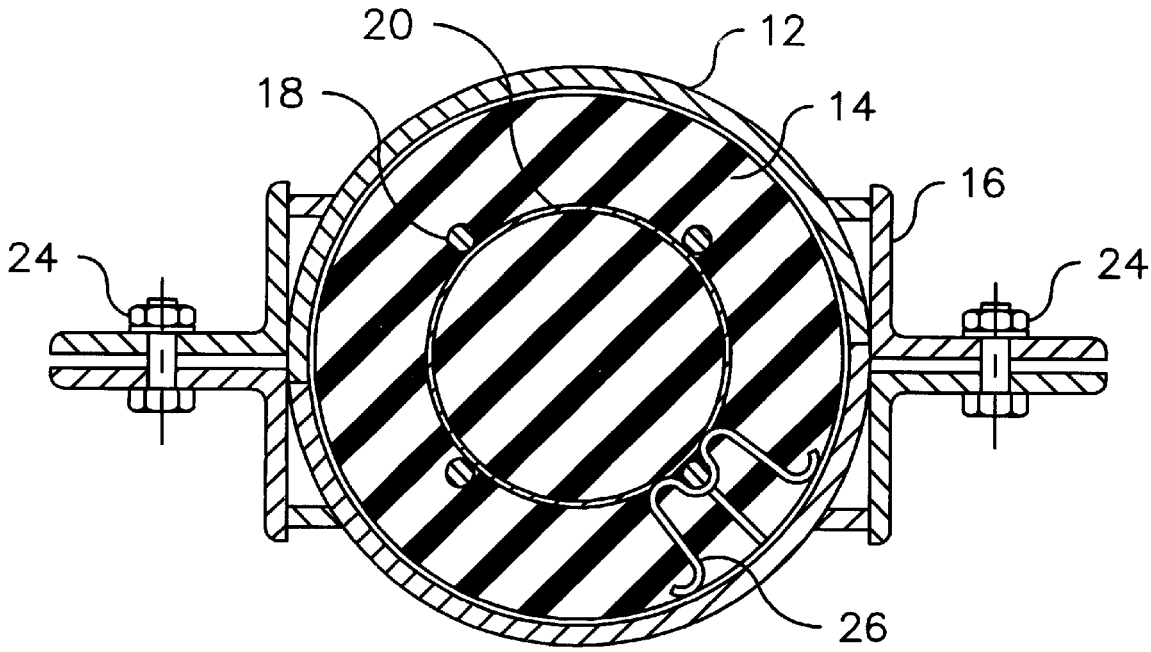

UTILITY POLE WITH PIPE COLUMN AND REINFORCING RODS COMPRISED OF SCRAP RUBBER AND PLASTIC

This appln is a C-I-P of Ser. No. 08/904,720 filed Aug. 1, 1997, abandoned.

BACKGROUND

1.—Field of Invention

This invention relates to the recycling of scrap automobile tires and ground plastic as a construction material in the production of a utility pole with a pipe column and reinforcing rod support.

BACKGROUND OF THE INVENTION

2.—Prior Art

Recycling of tires and plastic is not a new idea. In the early 1900's, many tire manufacturer's recycled scrap tires. However, as production costs declined, tire recycling almost disappeared, especially with the introduction of the steel belted radial. In the United States alone, there are over 250–300 million scrap tires accumulated annually, in addition to an existing supply of nearly 2 billion that are stockpiled, illegally dumped or privately stored. Waste scrap tires present landfill problems, are breeding grounds for mosquitoes and rats, and do not disintegrate to reduce their volume in stockpiling.

Several means of disposal of scrap tires are used today. For example, cement kilns now burn used scrap tires as a source of energy. Because the scrap tires yield high amounts of energy, they are a viable source of energy. This burning creates incredible amounts of dangerous emissions which include lead, mercury, dioxins and furons (recognized carcinogenic), and the unnecessary waste of a viable resource (scrap tires and ground plastic) make this method impractical. Another popular method, mixing ground tire rubber in asphalt, has proven to be ineffective and in some cases, dangerous. As was evidenced in the 'burning road" incident in Washington State, the steel remnants of tire buffing corrode and cause a reaction which will ignite the asphalt surface under high ambient temperatures. Rubber asphalt is costly, nearly double the cost as opposed to conventional asphalt. Finally, one popular method has been grinding the scrap tires into crumb rubber. Crumb rubber is derived from the chopping of the scrap tires through a grinder, then sifted through screens, and the scrap tires are reduced to a crumb, or mesh, with different grades and textures. The basis of this application addresses a new and improved use for the crumb rubber in molded recycling projects.

Plastics also create problems for disposal. Since the practice of landfilling plastics has practically disappeared in the United States, state and local governments have been placed with the burden of recycling. Plastics also present major problems in reclaiming projects. Because each type of plastic melts at different temperatures, and the process by which the plastic is made (injection molding, blow molding, etc.) will create imperfect end products if melted, the plastic industry has faced many obstacles in making reliable products. It has been the practice of plastic manufacturer's to mix the recycled material with virgin plastic and additives. However, tremendous amounts of toxins are produced when melting plastics. Millions of pounds of plastic each year are deemed unacceptable for use by recyclers in this country and end up being shipped overseas. As with used scrap tires, plastic can be ground into pellets through the use of grinders.

The new utility pole not only serves the purpose of disposing of the scrap tires and ground plastic, but also serves as savior for the old growth forests which are being destroyed. Currently in the United States, over 100,000,000 utility poles are in place and as the communication age demands more telephone lines, the demand for new poles will be at a constant demand for the foreseeable future. Utility poles have numerous problems both structurally and environmentally. They are treated with dangerous creosote or pentachlorophenol, which not only leeches into the groundwater but also prevents their use as landfill. Creosote, so long used to treat utility poles, has now been linked to problems caused to the lungs and central nervous system of animals and humans who are exposed to creosote for long periods of time. Preliminary studies are finding that each pole in itself is an extreme danger to the groundwater.

Many have recognized the shortcomings of the wooden utility poles and have made efforts to replace these poles with substitute materials. Concrete poles, which crack and are extremely heavy and hard to transport, have become prevalent in warmer climates as a substitute. Aluminum poles have also gained popularity but are now causing headaches in metropolitan areas due to increased risk of electrocution from wires that may be exposed from the base of the poles.

PRIOR ART

Previous patents have addressed the problem of scrap tire disposal, and more specifically, pole assemblies. Miller U.S. Pat. Nos. 5,246,754 (1993) and 5,472,750 (1995) teaches a utility pole comprised of scrap motor vehicle tires. Miller uses a process where the tire carcasses are cut, then are glued with a binder. No internal metal structure is for support is mentioned. Hammer U.S. Pat. No. 5,507,473 (1996) discloses a guardrail post having an internal metal structure surrounded by an outer plastic material. Farber U.S. Pat. No. 5,513,477 (1996) presents a telephone-like pole having an internal structure surrounded by premolded external segments. U.S. Pat. No. 5,471,809 (1995) to Frankel shows poles with external metal reinforcements. U.S. Pat. No. 5,412,921 (1995) to Tripp teaches an i-beam structure made of discarded tire belts, with no mention of a reinforcement. Borzakian U.S. Pat. Nos. 5,180,531 (1993) and 5,051,285 (1991) teaches of heating the plastic in a wet mix to make plastic pole reinforcement with no further explanation on how the pole will be used as a reinforcement for the utility pole. Borzakian does teach the plastic piling to be "typically 10 feet long", which does not provide the necessary length required for utility poles.

The patents referenced above have several disadvantages:

A) Utility poles require structural integrity as the length of the pole increases. Factors such as wind and stress will greatly affect the stability of the pole. Previous patents have ignored the need for reinforcement to molded recycled rubber products.

B) Segmented poles, poles that are coupled and joined, do not provide the necessary structural integrity at joints for lengths above 20 feet.

C) The end product must be both useful and economical.

D) Pollution becomes an issue as the tires are heated, creating deadly toxins.

It is the intent of the new utility pole to make a more durable, ascetically pleasing and environmentally friendly pole through the use of ground tire rubber and ground plastic. Because of the composition of ground tire rubber and ground plastic which make them virtually indestructible, problems with decay due to insects, woodpeckers, salt and other environmental forces, which destroy the wooden poles, will not be present in the new utility pole. One skilled in the art will recognize that this new utility pole takes the ground remains of scrap tires and ground plastic, which are acquired by making several passes through grinders to remove the steel components and reduce tire volume (a different grinder is used for the plastic), and through the combination of a urethane binder and fire retardant, create a utility pole.

Reference Numerals in Drawings

12 Steel Plate Casing
14 Scrap Rubber Emulsion
16 Steel Angle Casing Support
18 Reinforcing Rods
20 Pipe Column
22 Optional Fill in Access in Horizontal Position
24 High Strength Bolt
26 Bar Chair

BRIEF DESCRIPTIONS OF THE SEVERAL VIEWS OF THE DRAWINGS

"FIG. 1" Typical cross section of the assembly with steel casting forms and scrap rubber emulsion with optional reinforcing rods.

Figure 2:
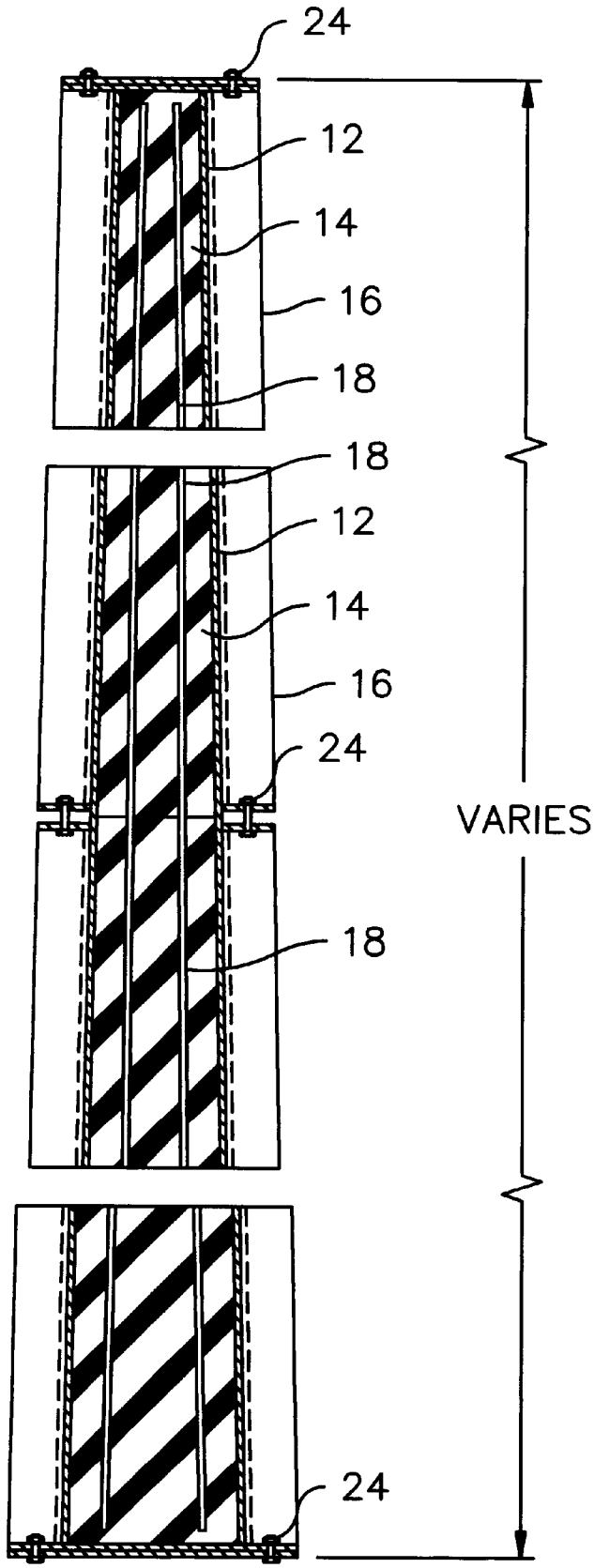

"FIG. 2" Typical Longitudinal section of the assembly with steel casting forms with extension and scrap rubber emulsion with optional reinforcing rods.

Figure 3:
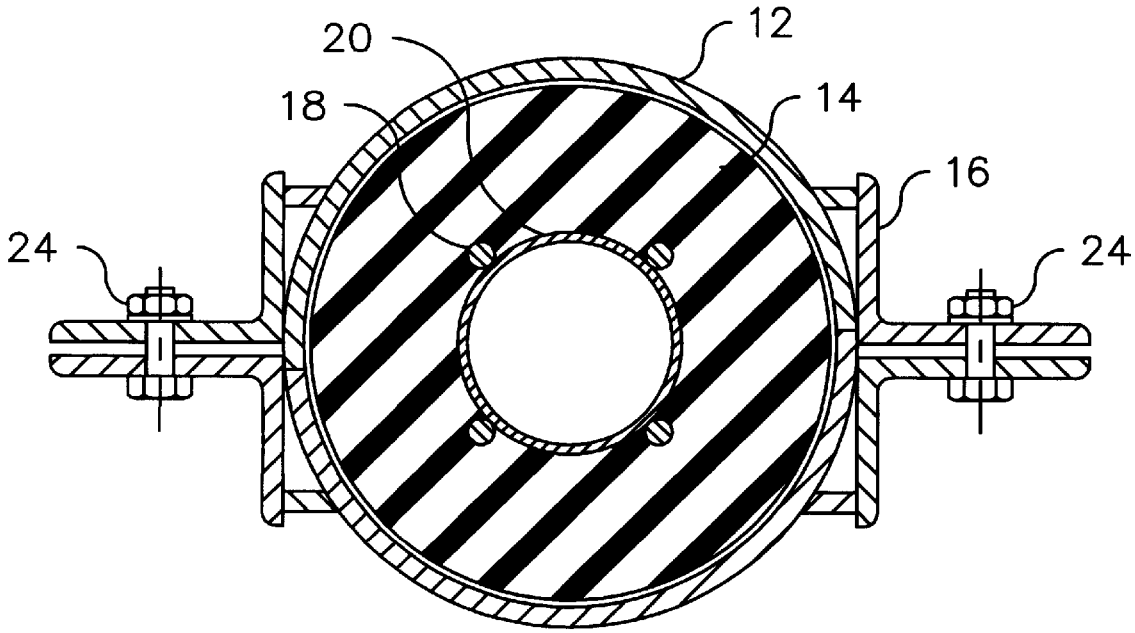

"FIG. 3" Typical cross section of the assembly showing optional reinforcing bars outside optional pipe column.

Figure 4:
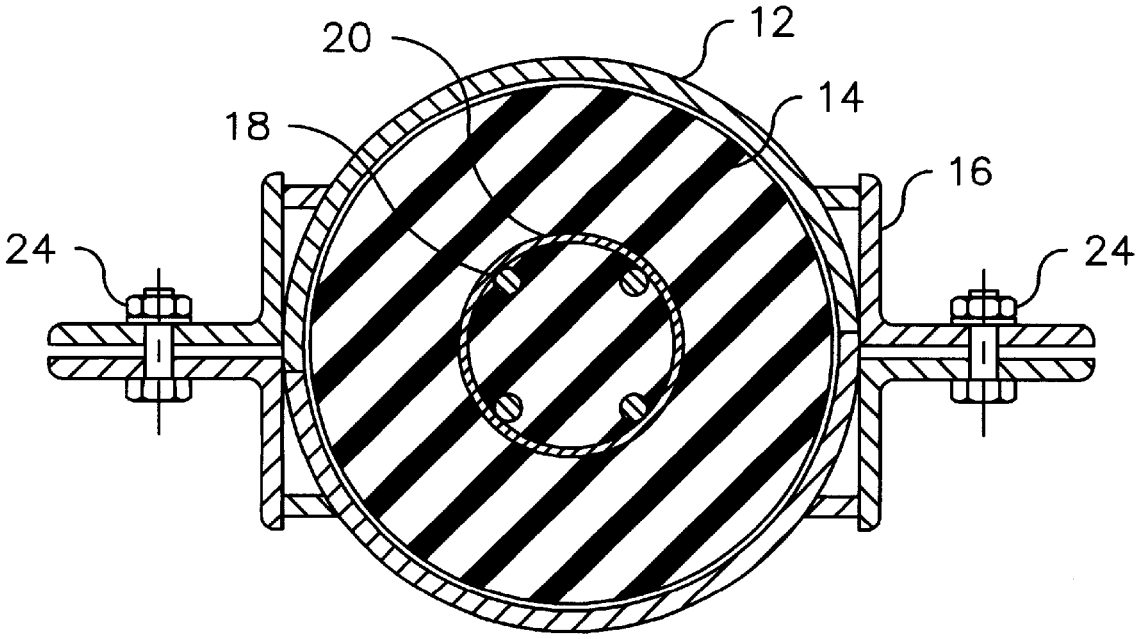

"FIG. 4" Typical cross section of the assembly showing optional reinforcing bars with optional pipe column with scrap rubber emulsion.

Figure 5:
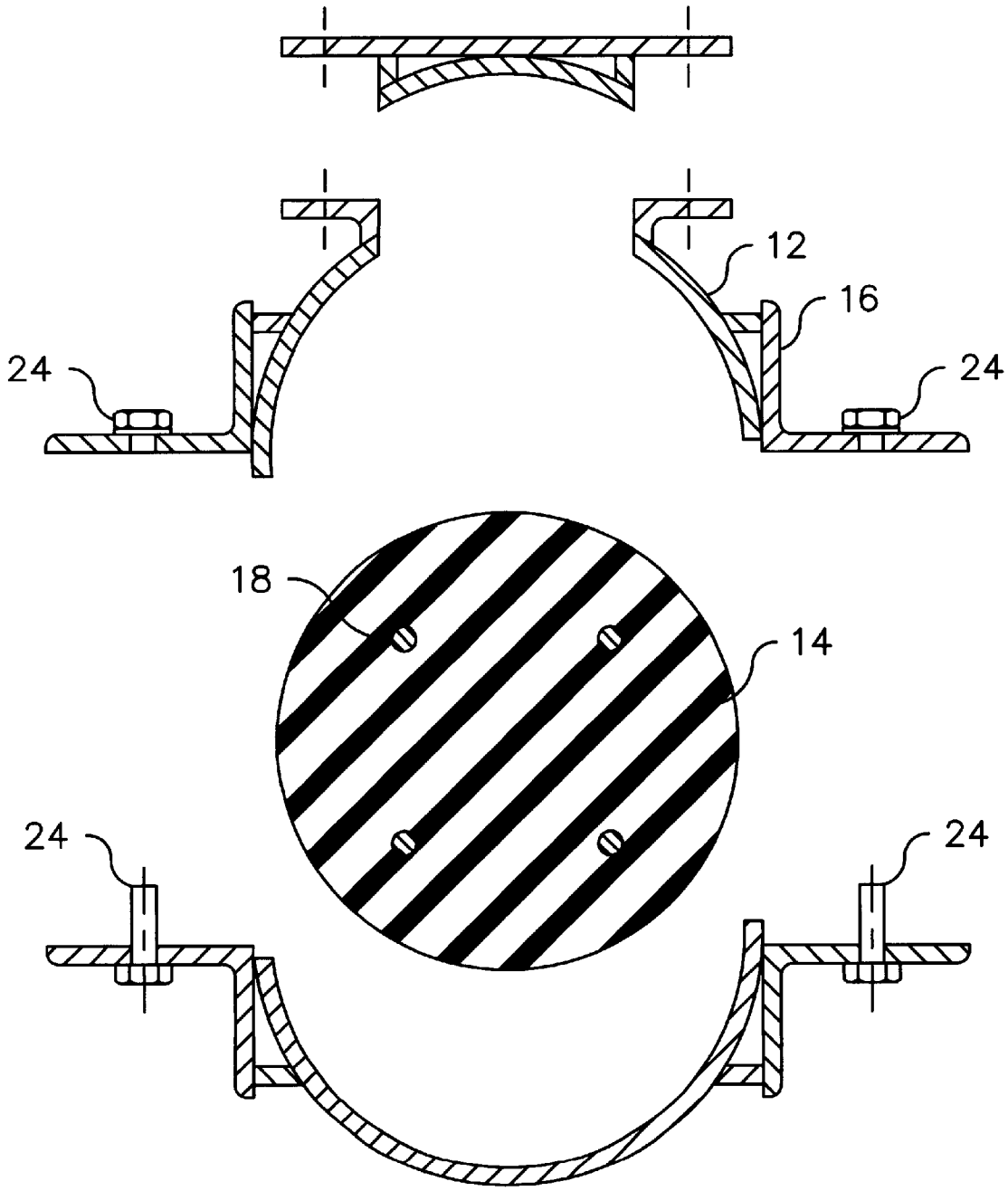

"FIG. 5" Typical cross section showing separate casing around utility pole with optional reinforcing.

Figure 6:
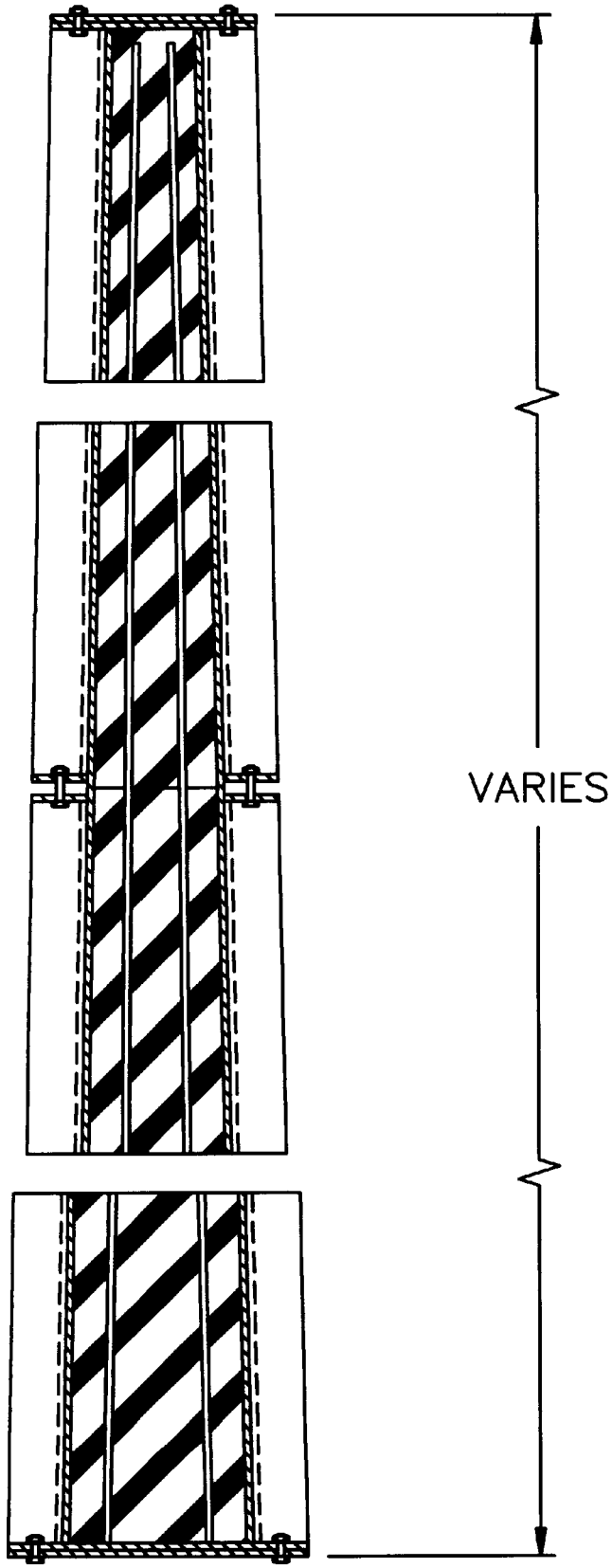

"FIG. 6" Typical cross section showing reinforcing rods extending to base.

Figure 7:
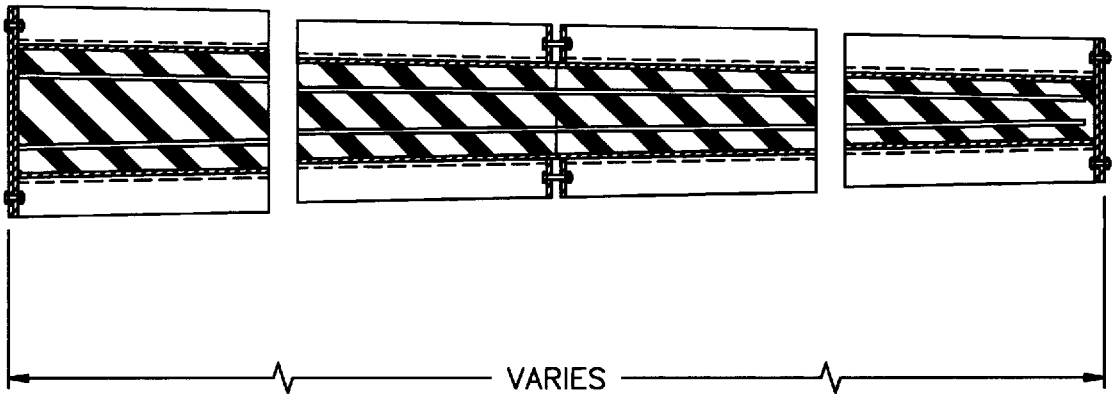

"FIG. 7" Typical horizontal cross section.

DETAILED DESCRIPTION OF THE INVENTION

The preferred embodiment of this new invention can be viewed in FIG. 2. The utility pole, tapered on the top, is supported by reinforcing rods 18 and a pipe column 20 and filled with a scrap rubber emulsion 14. Other shapes of the utility pole could be selected from the group consisting of octagon, pentagon square and cylindrical shapes. Generally, scrap rubber emulsion 14 is a combination of scrap tires in ground form, commonly known as ground tire rubber, ground plastic, a UV protectant and fire retardant with a urethane binder. The preferred urethane binder is Synair 2157 Prepolymer Duofome, manufactured by Synair Corporation. Preferably, the urethane binder will be mixed at a ratio of at least 5% volume scrap rubber emulsion 14, an ultraviolet protectant at no greater than 2% volume and fire retardant at no greater that 1% volume. The ground plastic shall consist of around 25% volume, and the remaining scrap emulsion will consist of ground tire rubber, preferably about 65% of the volume. The combination of the scrap rubber emulsion can be adjusted to achieve different properties. For example, if the utility pole requires more rigidity, the volume of ground plastic will increase, and can increase to an amount of around 40% volume. Conversely, if the utility pole needs flexibility, the amount of ground tire rubber will increase to around 95% volume.

The process of mixing scrap rubber emulsion 14 begins as all materials will be placed in a mixer. Stowe Corporation manufactures a suitable mixer. A larger and faster mixer would be employed as the amount of scrap rubber emulsion 14 increases for longer lengths of poles. If desired, a mold release agent can be applied to the inside of a steel plate casing 12. This mold release agent would be applied to the inside a pipe column 20 prior to filling the pipe column 20 with scrap rubber emulsion 14. Scrap rubber emulsion 14 shall be mixed for a period of at least 10 minutes to around 30 minutes and then released into steel plate casing 12 manually. Preferably, scrap rubber emulsion 14 will be placed on a conveyer belt after mixing and released into steel plate casing 12. Time in mixing can be influenced by several factors, most notably ambient temperature and humidity. Heat and humidity will allow scrap rubber emulsion 14 to set up quicker, while cooler temperatures will slow the set up time. The preferred temperature for mixing is around 70F. If desired, a catalyst can be added to the mixture to speed set up time. The catalyst will be added at no greater than 1% volume.

In FIG. 1 inside the steel plate casing 12 are the pipe column 20, scrap rubber emulsion 14 and reinforcing rods 18 which will be attached to a bar chair 26 for stability. FIG. 3 shows an embodiment without scrap rubber emulsion 14 inside pipe column 20. A steel angle casing support 16 is attached to steel plate casing 12 and joined by a high strength bolt 24 on both sides of steel plate casing support 16. The pipe column 20 typically will be made of aluminum, but can also be of any of the materials from the group consisting of steel, fiber resin, fiberglass, plastic or stainless steel. Pipe column 20 typically will be at least 2 inches in diameter to around 6 inches in diameter. Reinforcing rods 18 can be of any material from the group consisting of aluminum, steel fiber resin, fiberglass or plastic.

In FIG. 2, steel plate casing 12 is vertical; however, the casing can also be laid horizontally and fed through injection molding machinery. In the preferred embodiment, compaction of scrap rubber emulsion 14 is done through a hydraulic system utilizing rams and a gravity pour. Scrap rubber emulsion 14 will be dispensed inside steel plate casing 12 and will be compressed. Preferably, steel plate casing 12 will be at least 10 feet in length to around 70 feet to achieve the necessary length for utility poles. The applied pressure to scrap rubber emulsion 14 will be about 80 pounds per square inch to about 500 pounds per square inch. In order to achieve a smooth and consistent finish, scrap rubber emulsion 14 will be displaced into steel plate casing 12 filling about 20 percent of the length of the steel casing form. The applied pressure should be about 20 minutes in duration before pressure is released and additional scrap rubber emulsion 14 is displaced inside steel plate casing 12. Compression of scrap rubber emulsion 14 should reduce to about 10 feet inside steel plate casing 12, thus, a typical 50 foot length utility pole would require about 5 mixes and compression.

Inside steel plate casing 12 are reinforcing rods 18. Reinforcing rods 18 may be located behind pipe column 20 as shown in FIG. 3 or inside pipe column 20 as shown in FIG. 4. FIGS. 4 and 5 shows reinforcing rods 18. The purpose of reinforcing rods 18 is for additional structural integrity. In order for the rods to remain stationary as material is compacted inside steel plate casing 12, they are attached to the base of steel plate casing 12 by a bar chair 26 in FIG. 1. Bar chair 26 is used as a support for reinforcing rods 18 to assure stability during the compaction process. Bar chair 26 will also allow pipe column 20 stability against the reinforcing rods 18. Typically, the bar chair 26 will be at least 1¾" in height. The bar chair 26 as shown in FIG. 1 can also be attached to pipe column 20, but preferably will be attached to the base of the steel plate casing 12. Typically, these rods will be at least ¼" in diameter to around 1½" diameter. A pipe column 20 is centered within steel plate casing 12 and can be filled with scrap rubber emulsion 14 or left hollow.

After the final compaction, pressure will continue to be applied to the scrap rubber emulsion 14 for a period of at least 2 hours to around 24 hours. The purpose of the compaction is to make a denser finished utility pole; however, pressure can be released in as little as 20 minutes on the final compaction. The shorter the period of compaction, the less dense the utility pole shall be.

The final step is to remove the utility pole from the steel plate casing 12. In FIG. 1 a high strength bolt 24 is attached to each end of the cast reinforcing and is detached from the member and cast reinforcing is detached from the utility pole member. The utility pole is then removed from the steel plate casing 12 as shown in FIG. 5 by unbolting the high strength bolts 24. FIG. 5 also shows an embodiment where the member has a optional fill in access in a horizontal position 22. FIG. 6 shows an embodiment where reinforcing rods 18 extend to the base of the steel plate casing 12. A plate can be inserted at the bottom of the steel plate casing 12 with holes drilled inside the plate to hold the reinforcing rods 18 stationary with or without the use of the bar chair 26. In FIG. 7, an embodiment is shown in a horizontal position.

One skilled in the art can easily determine the usefulness and simplicity of the utility pole. This method as described above has many applications for scrap rubber projects including bulkheads, guard rails, median barriers and pilings. Due to the many variables that are required of those who are end-users of the utility pole, many variations according to the strengths and sizes necessary can be made.

I claim:

1. A elongated member comprising of:

a scrap rubber emulsion comprised of ground tire rubber, fire retardant, ground plastic, a urethane binder and ultraviolet protectant compressed in a steel plate casing with reinforcing rods inside a pipe column with steel angle casing support of at least 10 feet in length to about 70 feet in length wherein the urethane binder is mixed at a ratio of at least 5% by volume to the scrap rubber emulsion, the ultraviolet protectant is no greater than 2% by volume b, the fire retardant is no greater than 1% by volume, the ground plastic is no greater than 40% by volume and the remaining scrap emulsion will consist of ground tire rubber, of about 65% of the volume wherein the shape of the member is selected from the group consisting of pentagon, octagon, square, cylindrical and tapered.

2. The member of claim 1 wherein the reinforcing rods have a diameter in the range of from ⅛ inch to about 1½ inches and the pipe column has a diameter in the range of about 2 inches to about 6 inches, and wherein the scrap rubber emulsion is compressed inside the steel plate casing with reinforcing rods outside of the pipe column with steel angle casing support.

3. The member of claim 1 wherein:

the binder and scrap emulsion are compressed inside the pipe column, and wherein applied compression of the material is in the range of at least 50 psi to about 800 psi.

4. The member of claim 1 wherein the pipe column is selected from the group consisting of aluminum, steel, fiber resin and fiberglass, and wherein the reinforcing rods are selected from the group consisting of aluminum, steel, fiber resin, fiberglass and stainless steel.

* * * * *